United States Patent [19]

Phillips et al.

[11] Patent Number: 4,840,281

[45] Date of Patent: Jun. 20, 1989

[54] TAMPER EVIDENT OPTICAL DEVICE AND ARTICLE UTILIZING THE SAME

[75] Inventors: Roger W. Phillips; Vernon C. Spellman; Wayne L. Gossett; Marc A. Kamerling; Paul G. Coombs, all of Santa Rosa, Calif.

[73] Assignee: Optical Coating Laboratory, Inc., Santa Rosa, Calif.

[21] Appl. No.: 147,891

[22] Filed: Jan. 25, 1988

Related U.S. Application Data

[63] Continuation-in-part of Ser. No. 894,320, Aug. 7, 1986, Pat. No. 4,721,217.

[30] Foreign Application Priority Data

Jul. 8, 1987 [JP] Japan ..... 62-198004
Jul. 31, 1987 [EP] European Pat. Off. ..... 87306825.8

[51] Int. Cl.[4] ..... B65D 55/02

[52] U.S. Cl. ..... 215/230; 206/459; 229/102; 350/166

[58] Field of Search ..... 215/230, 365, 366; 206/459, 807; 229/102; 350/166

[56] References Cited

U.S. PATENT DOCUMENTS 3,858,977 1/1975 Baird et al. ..... 350/166 X
4,475,661 10/1984 Griffen ..... 215/366
4,480,749 11/1984 Laucis et al. ..... 206/459

*Primary Examiner*—Donald F. Norton
*Attorney, Agent, or Firm*—Flehr, Hohbach, Test, Albritton & Herbert

[57] ABSTRACT

Tamper evident optical device having at least first and second layers with a spacer layer therebetween and providing a desired optical property. A release layer is disposed between the first and second layers which permits the first and second layers to be separated from each other and to destroy the desired optical property.

27 Claims, 3 Drawing Sheets

TAMPER EVIDENT OPTICAL DEVICE AND ARTICLE UTILIZING THE SAME

This application is a continuation-in-part of application Ser. No. 894,320 filed Aug. 7, 1986, now U.S. Pat. No. 4,721,217.

This invention relates to a tamper evident optical device and to an article utilizing the same.

Because of tampering with certain consumer-type products, there has been an attempt to make such products more tamper proof, or in other words, tamper resistant. Even though many changes have been made to make consumer type products more tamper resistant, the tamper resistant packaging provided still can be violated. In view of the fact that making packaging more tamper proof is expensive and often makes the consumer type products more difficult to utilize by the consumer, there is a need for a different approach to attempt to solve the problems. Thus for example, rather than attempting to make the consumer type products more tamper resistant, an alternative approach which may be preferable is to make the package in such a way so that if tampering occurs it will be evident to the consumer at the point of sale. There is therefore a need for a device which can be utilized on articles such as packages and containers which will make it apparent to the consumer at the point of sale if tampering has occurred.

In general, it is an object of the invention to provide an optical device which can be utilized with packaging to indicate to the consumer when tampering has occurred.

Another object of the invention is to provide an optical device of the above character which can be utilized in conjunction with containers.

Another object of the invention is to provide an optical device of the above character which can be incorporated into packaging utilizing conventional packaging equipment.

Another object of the invention is to provide an optical device of the above character which is an optically variable device.

Another object of the invention is to provide an optical device which changes appearance when separated into two parts.

Another object of the invention is to provide an optical device of the above character in which a release layer is provided between the layers and wherein the separation occurs in or adjacent to the release layer.

Another object of the invention is to provide an optical device of the above character which changes color when separated into two parts.

Another object of the invention is to provide an optical device of the above character which does not shift color with a change in angle.

Another object of the invention is to provide an optical device of the above character which has a dark appearance before separation and a light appearance after separation.

Another object of the invention is to provide an optical device of the above character which can carry an imprint within the same.

Another object of the invention is to provide an optical device of the above character in which the imprint can be colored.

Another object of the invention is to provide an optical device of the above character in which there is a color shift with angle change.

Another object of the invention is to provide an optical device of the above character in which certain optical properties are destroyed when the integrity of the packaging has been violated.

Additional objects and features of the invention will appear from the description in which the preferred embodiments are set forth in detail in conjunction with the accompanying drawings.

In general the tamper evident optical device of the present invention is comprised of an optical device having at least first and second layers which provide the optical device. A release layer is disposed between the first and second layers of the optical device to permit the first and second layers of the optical device to be separated to destroy certain optical devices. In certain applications, the optical device is formed as a dark or black mirror which is destroyed upon separation of the optical device into two or more parts. Alternatively, the optical device can have a color which does not shift with angle whose color is destroyed when the optical device is separated. In another embodiment the optical device has optical shifting properties with angle which are destroyed when the device is separated into two parts.

The article which utilizes the tamper evident optical device has first and second parts which are movable with respect to each other. The tamper evident optical device has its first and second layers secured respectively to the first and second parts of the article so that when the first and second parts of the article move with respect to each other, the release layer permits the movement of the first and second layers with respect to each other to destroy certain of the optical properties of the optical device.

Figure 1:
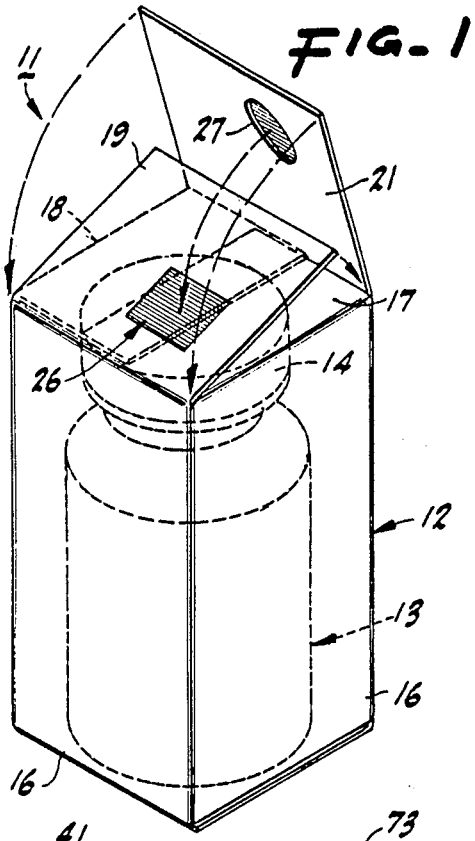
FIG. 1 is a perspective view of a package and container of the present invention incorporating a tamper evident optical device.

More particularly as shown in the drawings, the tamper evident optical device and the article utilizing the same as shown in FIG. 1 consists of a container package 11. The container package 11 consists of a box 12 which contains therein a bottle 13 having a cap 14 threadedly mounted thereon. The bottle 13 can be formed of any suitable material such as glass or plastic. Similarly, the cap 14 can also be formed of a suitable material such as metal or plastic. As shown the bottle 13 has a conventional cylindrical configuration. The box 12 also is of a conventional cardboard type and is of a generally rectangular configuration. The box is formed in a conventional manner and is provided with flaps for closing the ends. The box is provided with four side walls in which adjoining side walls extend at right angles to each other. Four flaps 17, 18, 19 and 21 are provided on each end of the box 12. Two of the flaps, as for example, 19 and 21 serve as first and second parts of the box and are movable with respect to each other.

Figure 2:
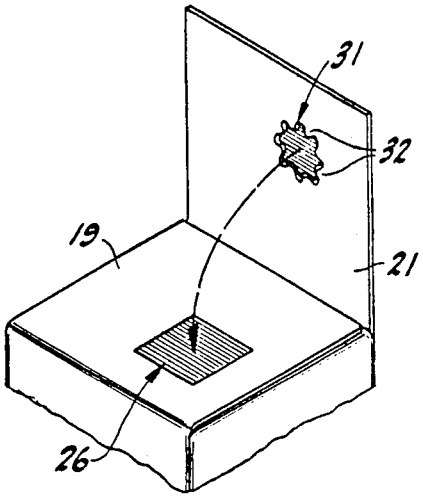
FIG. 2 is a perspective view of a package containing another embodiment of the present invention.

The tamper evident optical device 26 of a type hereinafter described is disposed between the flaps 19 and 21. An aperture window 27 is provided in the outer flap 21 to permit viewing of the optical device 26 to see whether or not it has angle shifting properties. As can be seen from FIG. 1, the window 27 has a circular configuration. Other configurations can be utilized if desired. For example as shown in FIG. 2, another type of window 31 has been provided which has serrations 32 formed in its margins which serve a purpose as hereinafter described.

Figure 3:
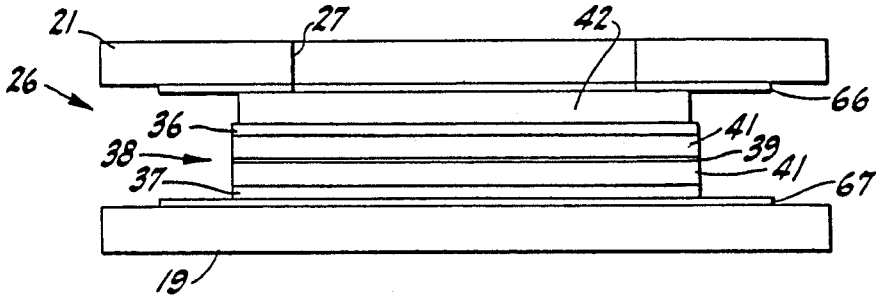
FIG. 3 is a cross-sectional view of a tamper evident optical device utilized on a container such as a bottle incorporating the present invention.

The tamper evident optical device 26 of the present invention can be of the type shown in FIG. 3. As shown therein, the tamper evident optical device 26 can be of the type described in co-pending application Ser. No. 630,414 filed on July 13, 1984, now U.S. Pat. No. 4,705,356. As described therein, it is comprised of at least first and second layers 36 and 37 which form part of a metal-dielectric-metal interference filter 38. A release layer 39 is disposed between first and second layers 36 and 37 and, as shown, is provided in a spacer layer 41. The layers 36, 37, 39 and 41 are formed upon and carried by a substrate 42 to provide the interference filter 38.

Figure 4:
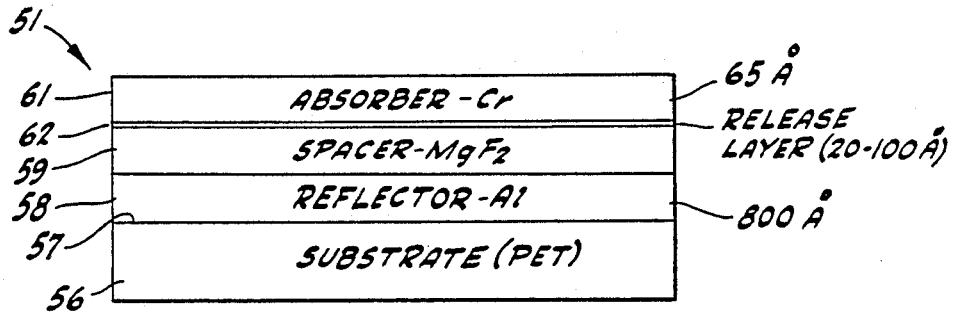
FIGS. 4, 5 and 6 are cross-sectional views of three different designs for tamper evident optical devices for use in a package.
Figure 5:
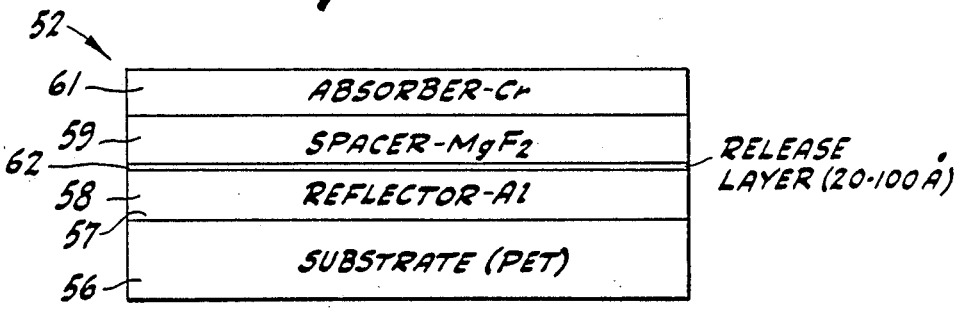
Figure 6:
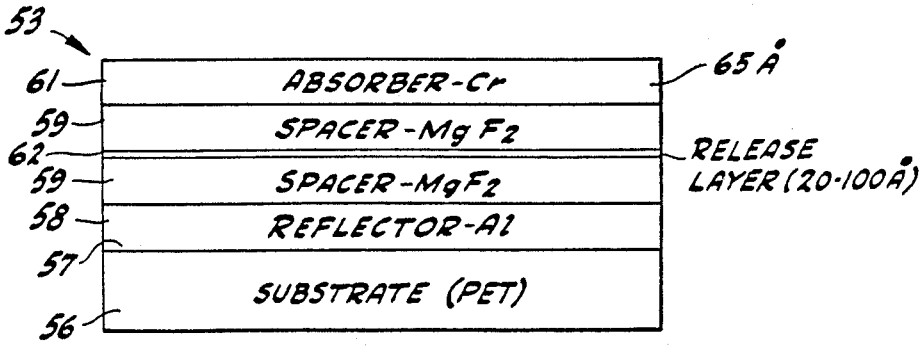

The release layer 39 is disposed between the absorber layer and the reflector layer. Three general designs of the tamper evident optically variable device of the present invention are shown in FIGS. 4, 5 and 6. Each of the designs consists of a substrate 56 which has at least one surface 57. The substrate 56 is formed of a suitable material of the type described in co-pending application Ser. No. 630,414 filed on July 13, 1984, now U.S. Pat. No. 4,705,356. As described therein it can be formed of polyethylene terephthalate (PET). Typically the substrate 56 can be formed of material having a thickness ranging between 50 gauge and 700 gauge which would be approximately 0.00050 inches to 0.007 inches. The substrate material is preferably transparent. However, if desired it can be opaque.

A reflector layer 58 is deposited on the surface 57 of the substrate 56. The reflector layer 58 is formed of a metal and is deposited to a thickness so that it is opaque. The metal utilized should preferably be a high reflector such as aluminum. Other metals can be utilized which have a whitish appearance and which have good reflection characteristics. For example, reflectors such as nickel and silver (if stabilized) could be used. In addition, other materials such as commonly known grey metals can be utilized if their lower reflection characteristics can be tolerated. The metal utilized should be deposited to a thickness so it is opaque. If aluminum is used, this would be a thickness of approximately 600 Angstroms±20%.

A dielectric spacer layer 59 is deposited on the metal reflector layer 58. In order to obtain as rapid a color shift as possible, it is desirable that the spacer layer be formed of a material having a very low index of refraction. For that reason, the layer is formed of a dielectric having an index of refraction of $n=1.9$ or below. Materials meeting this criteria are inorganic materials like magnesium fluoride, $n=1.38$; yttrium fluoride, $n=1.55$; silicon dioxide, $n=1.45$, etc. Organic materials such as TFE (tetrafluoroethylene, Teflon®), $n=1.38$; FEP (fluorinated ethylene-propylene copolymer) $n=1.34$; polypropylene, $n=1.45$; polyethylene, $n=1.5$; polyethylene terephthate (PET, Mylar®) $n=1.6$; or waxes, $n=1.5$ may be utilized. The spacer layer 59 is put down to a thickness ranging from between 3 and 7 quarter waves with a design wavelength in the visible spectrum that ranges from 400 to 700 microns. It has been found that if more than 7 quarter waves are utilized the color becomes muted or becomes white. If approximately less than 3 quarterwaves are utilized, there is insufficient color shift.

A metal absorber layer 61 is deposited on the spacer layer 59. The thickness of the spacer layer 59 determines which wavelengths will be absorbed by the absorber layer 61. Thus it can be seen that by changing a thickness of the spacer layer, different colors can be obtained for the color shift desired with the optically variable device. The absorber layer 61 is formed of a highly absorbing material such as a metal and is put on to a thickness so that it provides substantially zero reflection at the selected design wave length in the visible spectrum. The metal which is utilized in the absorber layer 61 can be any of the grey metals such as chromium, nickel, titanium, vanadium, cobalt and palladium. The use of such grey metals for the absorber layer 61 is desirable because the gray metals have high absorption values. A grey metal can be characterized as a metal having high absorption where the n & k are nearly equal and the ratio of k over n is small as, for example, in the range of 1:2. When the grey metal is placed on the spacer layer to provide a minimum of reflection at the selected design wavelength in the visible spectrum, it has a thickness which is in the vicinity of 100 Angstroms or less. For example, if the absorber layer is formed of chromium, it can have a thickness of approximately 65 Angstroms±10%.

In the optically variable devices shown in FIGS. 4, 5 and 6, it can be seen that a metal dielectric metal or tri-layer system design has been provided in which the spacer layer serves the critical function providing the desired color shift. In each of the three designs, a release layer 62 has been incorporated, either in the spacer layer 59 itself or on opposite sides of the spacer layer 59. Thus as shown in FIG. 4, the release layer 62 has been provided between the absorber layer 61 and the spacer layer 59. In the design shown in FIG. 5, the release layer 62 has been provided between the spacer layer 59 and the reflector layer 58. In the third design shown in FIG. 6, the release layer 62 has been provided between the two separate portions of the spacer layer 59.

The release layer 62 is formed of a material having an index of refraction which is close as possible to the index of refraction of the spacer layer 59 so that it does not effect to a significant degree the optical properties of the optically variable device. The release layer 62 should be formed of a material which permits separation of the metal-dielectric-metal interference filter which comprises the optically variable device. One material found to be particularly satisfactory for this purpose is Teflon which is flashed onto the appropriate layer in the desired position as shown by any one of the three designs shown in FIGS. 4, 5 and 6 to a suitable thickness as for example, from 20 to 100 Angstroms. By providing such a release layer 62 it is possible to readily separate the absorber layer from the reflector layer and thus destroy the optically variable effects of the optically variable device to render the optically variable device non-functional. By separating the absorber layer from the reflector layer, the phase coherence of the interference filter is destroyed. Once this phase coherence has been destroyed, it is impossible to re-establish this phase coherence even if an attempt is made to reassemble the two separated parts. It has been found that once an optically variable device has been separated in a manner in which the absorber layer is separated from the reflector layer, the color shift characteristics have been destroyed. Even if it would be possible to restore some color shift characteristics, a different color shift or color resembling an oil slick would occur which would clearly disclose that the optically variable device had been tampered with. Attempts to re-establish the optically variable device by gluing together the two parts would result in failure because the glue itself would have some finite thickness which would make it impossible to restore the color shift characteristics so that a single color would still remain or, at best, a different color shift would be achieved.

The designs shown in FIGS. 4–6 can also be used in the reverse configuration on the substrate 56. In this instance, the color shift would be seen through the substrate 56 and would by necessity be optically transparent.

By way of example, optical devices incorporating the present invention with release layers therein have been provided in which color shifts have been achieved. One optically variable device had a green color in reflectance when viewed at normal incidence and at a viewing angle of approximately 45°, it had a blue color. After it was pulled apart all that could be seen on one side was an aluminum reflector and on the other side a greyish color in transmission and at an angle only a tinge of blue in reflection. Thus the optically variable device after it once had been separated by the use of the release layer and then placed together again would have a silvery color at all angles, i.e., no color change with angle, which would clearly indicate that the optically variable device had been separated. In other words, the optically variable device had its color shift capabilities destroyed clearly indicating tampering with the optically variable device.

The optical device 26 can be any one of the optically variable devices 51, 52 and 53 described in FIGS. 4, 5 and 6. As shown in FIG. 3, the optically variable device can be incorporated between the two flaps 19 and 21 of the cardboard carton or container 11. Suitable means is provided for securing the optically variable device to the flaps 19 and 21 and as shown in FIG. 3 can take the form of layers 66 and 67 of a suitable adhesive. The layer 66 secures the flap 21 to the substrate 42 and the adhesive layer 67 secures the flap 19 to the layer 37. After the optically variable device has been glued between the two flaps 19 and 21 by the use of the adhesive layers 66 and 67 and is positioned in such a manner so that it is visible through the opening 27, a color shift with angle can be ascertained. By way of example, at normal incidence, the optically variable device will have a green appearance and at an angle of approximately 45°, the optically variable device will have the color of blue.

When the outside flap 21 is opened, the optically variable device 26 will be separated at the release layer 39. As soon as the optically variable device has been separated, the angle shifting properties are destroyed. Thus it can be seen that if such an optically variable device were to be utilized on a package for a consumer type product, the consumer picking up the product from a store shelf could readily ascertain whether or not there had been any tampering with the product by viewing the optically variable device to ascertain whether or not a color shift occurs with change of viewing angle. If there is no color shift, then the consumer knows that the product has been tampered with and should not be purchased.

In the embodiment shown in FIG. 3 it can be seen that the reflector can be deposited on the substrate followed by the spacer layer and the absorber layer. In certain applications, it may be desirable to reverse this sequence by depositing the absorber layer on the substrate followed by the spacer layer and then depositing the reflector layer. When manufactured in this manner, the optically variable device can be mounted in the manner shown in FIG. 3 in which the substrate 42 faces the opening making it necessary to view the optically variable device through the polyester film which is utilized for the substrate. Such an arrangement is desirable because the polyester film inhibits cutting through the optically variable device and removing a portion of the optically variable device. Such cutting operations can be inhibited by the use of serrations 32 as shown in FIG. 2. By providing such serrations, it would be very difficult, if not impossible, to remove a portion of the optically variable device and affix it to another carton already tampered with without destroying the same. It should be appreciated that if desired, the optically variable device can be positioned in such a manner so that the substrate is positioned away from the opening 27.

Figure 9:
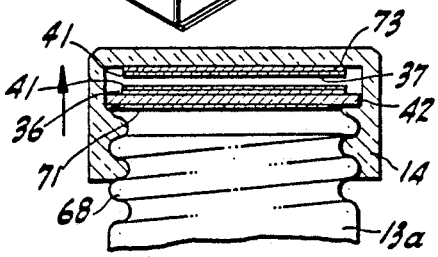
FIG. 9 is a cross-sectional view showing the manner in which the optical device incorporating the present invention can be destroyed.
Figure 8:
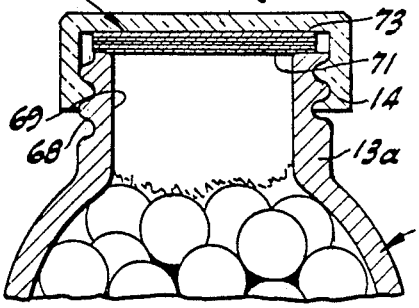
FIG. 8 is a cross-sectional view similar to FIG. 7 but showing a transparent cap mounted on the container.
Figure 7:
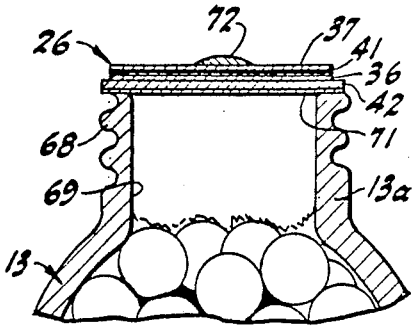
FIG. 7 is a partial cross-sectional view showing the upper portion of a container having an optical device mounted thereon.

Another embodiment of the invention is shown in which the tamper evident optically variable device is incorporated into the bottle itself rather than into the package containing the bottle. This embodiment is shown in FIGS. 7, 8 and 9. As shown therein, the bottle 13 is provided with a necked portion **13*a* which is provided with external threads 68 which are adapted to receive the cap 14 which encloses the opening 69 in the neck 13*a*. An optically variable device 26 of the type hereinbefore described is sized to fit over the top of the necked portion 13*a* and has one side of the same, as for example, the substrate side secured to the top of the necked portion 13*a* by suitable means such as an adhesive layer 71. After the optically variable device 26 has been applied to the top of the bottle 13, a clear adhesive 72 is applied to the top of the optically variable device 26 as shown in FIG. 7 and thereafter the cap 14 is screwed onto the necked portion 13*a* of the bottle 13 to spread out the glue 72 to form an adhesive layer 73 between the cap and the optically variable device 26. The cap 14 as shown is transparent so that the optically variable device 26 can be viewed through the adhesive and top of the cap. It should be appreciated, if desired, a portion of the cap can be formed so it is opaque with only a portion of the same being transparent so as to permit viewing of the optically variable device 26**.

When the bottle 13 is opened by rotating the cap 14, the optically variable device 26 is destroyed because the adhesive layers 71 and 73 hold the optically variable device 26 to the top of the neck of the bottle 13*a* and the bottom inside of the cap 14 so that rotation of the cap 14 causes a shearing action to take place within the optically variable device 26 along the plane of the release layer provided within the spacer layer 41 to cause the optically variable device to separate as shown in FIG. 9, and to cause destruction of the angle shifting characteristics of the optically variable device. Thus again it can be seen that if the bottle has been tampered with, the optically variable device will be destroyed which will give a visible indication to the consumer that tampering has occurred because the angle shift properties causing the changes in color with viewing angle will no longer be present.

Figure 10:
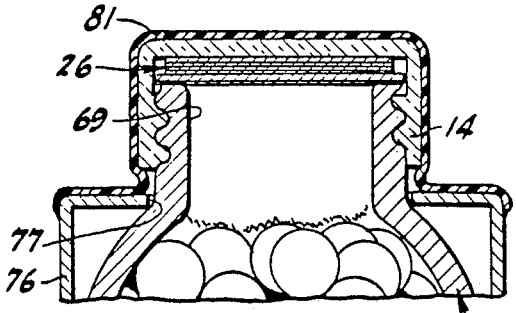
FIG. 10 is a partial cross-sectional view of a container utilizing a tamper evident optical device and also utilizing a shrink wrap fitting.

Another embodiment of consumer type packaging is shown in FIG. 10 and consists of a rectangular cardboard container or package 76 which can be rectangular in cross section and which is provided with an opening 77 in its top side through which the necked portion 13*a* of the bottle 13 can extend. The bottle is provided with a transparent cap 14 of the type hereinbefore described through which the optically variable device 26 positioned therein can be viewed. A shrink wrap 81 of a conventional type also formed of a transparent plastic can be applied to the top of the bottle and to the top of the container 76 to facilitate handling of the package. In such an embodiment it is still possible to view the optically variable 2 through the transparent wrap 81 and also through the transparent cover 14 to see whether or not tampering has occurred with respect to the bottle 13 by viewing the optically variable device 26 to see whether the angle shift properties are present.

Figure 11:
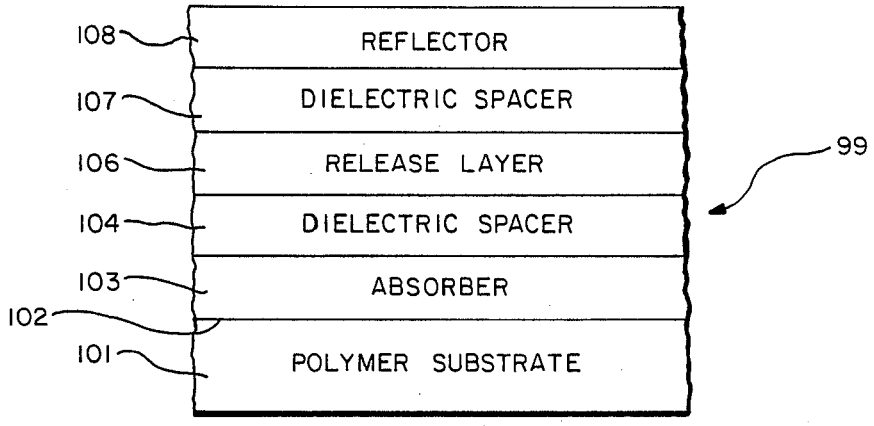
FIG. 11 is a cross-sectional view of another design for a tamper evident optical device incorporating the present invention.
Figure 12:
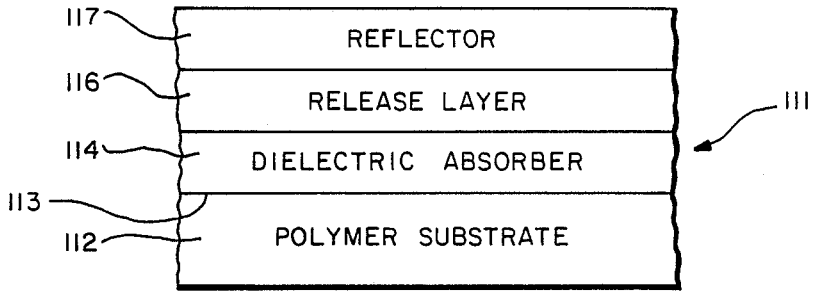
FIG. 12 is a cross-sectional view of still another design for a tamper evident device incorporating the present invention.

Although designs for optically variable optical devices of the type were disclosed and described in connection with FIGS. 4, 5 and 6 it should be appreciated that within the present invention optical tamper evident devices can be provided which utilize other than interference films that change color with viewing angle. Such designs for optical tamper evident devices are shown in FIGS. 11 and 12. As shown in FIG. 11, a polymer substrate 101 is provided which can be formed of a suitable polymer such as a PET or polycarbonate in a thickness ranging from 50 gauge to 700 gauge which corresponds to approximately 0.00050 inches to 0.007 inches. By way of example, the substrate 101 can be formed of a PET four mils in thickness corresponding to 0.004 inches. The substrate 101 is provided with a surface 102 on which there is deposited an absorber layer 103 which is formed of a highly absorbing material having an absorption coefficient in excess of 0.05 such as chromium, nickel and Inconel evaporated in a vacuum to a suitable thickness ranging from 30 to 150 Angstroms. Three additional layers 104, 106 and 107 which serve as a combined spacer layer are then evaporated onto the absorber layer 104 in sequence. The combined spacer layer is comprised of two dielectric spacer layers 104 and 107 separated by a release layer 106. The three layers 104, 106 and 107 operate in concert to provide a combination serving as a single spacer layer with a release layer therebetween to provide the desired result. If the color black or a dark mirror is desired, the three layers in combination should have a combined optical thickness of one-quarter wavelength at 350 to 450 nanometers with the dielectric possessing an index of refraction of greater than 1.0. If a color other than black is desired, then the combination of the three layers should have an optical thickness of one-quarter wavelength at 450 nanometers and above using a dielectric of any desired index of refraction. If a device is desired which shifts color with angle in accordance with the designs or embodiments shown in FIGS. 4, 5 and 6, then the three layers in combination should have an optical thickness greater than one-quarter wavelength at 450 nanometers with the dielectric having an index of refraction of 1.9 and below.

By way of example to provide a black color or dark mirror for the optical tamper evident device 99, the dielectric spacers 104 and 107 can be formed of a suitable material such as silicon dioxide having an index of refraction of 1.45 and having individual thicknesses ranging from 240 to 380 Angstroms and preferably approximately 310 Angstroms. The release layer 106 is of the type hereinbefore described in connection with the optically variable devices and as hereinbefore disclosed should have an index of refraction which is close as possible to the index of refraction of the dielectric spacer layers so that it does not affect to a significant degree the optical properties of the optically variable device. As also pointed out the release layer 106 should be formed of a material which permits separation of the optical tamper evident device into two parts. In connection with the present embodiment it has been found that cryolite, $Na_3AlF_6$, is a suitable material which is deposited at a thickness ranging from 20 to 100 Angstroms and preferably to a thickness of approximately 60 Angstroms.

When a single color other than black is desired, the dielectric spacers 104 and 107 are formed of a material having a high index of refraction. Suitable materials are zinc sulfide, cerium stannate and cerium oxide which are deposited to a suitable combined thickness ranging from 690 to 1700 Angstroms. The combined thickness of the layers 104, 106 and 107 is chosen to provide the desired color. In the example where the combined optical thickness for two quarter wavelength or one half wave is at 550 nanometers, a green color is obtained. Similarly at 650 nanometers a magenta color is obtained. Other colors in the spectrum can be obtained by selecting the appropriate optical thickness.

After the layers 104, 106 and 107 have been deposited, a reflector layer 108 is provided. As explained in connection with the previous embodiments, the reflector layer is formed of a material to provide a high reflection and typically which has a silvery appearance.

Such a material as previously described is aluminum, however other materials such as nickel, chromium and silver can be utilized if desired. The material should be deposited to a thickness ranging from 400 to 1000 Angstroms and typically for a aluminum can have a thickness of 800 Angstroms. It is necessary that the layer have a thickness so that it is opaque to visible light.

In utilizing the optical tamper evident device which is shown in FIG. 11 in connection with the tamper evident packages hereinbefore described, it is apparent that the optical tamper evident device can be utilized in the same manner. Thus, when the combination of three layers utilize a dielectric that has an index of refraction greater than 1.0 and the selected quarterwave optical thickness is between 350 and 450 nanometers, the optical tamper evident device has a black or dark mirror color. When the optical tamper evident device is tampered with, it separates into two parts at the release layer 106. This will cause the color to change from the black appearance to a reflective aluminum or silvery appearance to indicate that tampering has occurred with respect to the package. Once the characteristics of the optical interference device have been destroyed, they cannot be re-established by merely pushing the two parts together. The silvery color will remain and the black or dark mirror coloration will not reappear.

If a material possessing a high index of refraction (for example, above 1.9) is utilized with an optical thickness greater than 450 nanometers, the optical tamper evident device when utilized in a package will have a colored appearance of the chosen color, for example, green or magenta. When separation occurs between the parts at the release layer, the color will change from the selected color to the reflective aluminum or silvery color again to clearly indicate that tampering has occurred with the package. Because of the characteristics of the optical tamper evident device, the color cannot be restored merely by pushing the two parts together.

With respect to the combination of three layers 104, 106 and 107 shown in FIG. 11, it should be appreciated that it is possible to achieve substantially the same effects by combining the thicknesses of the two dielectric spacers 104 and 107 in a single layer on one side or the other of the release layer and having the release layer either in contact with the reflector on one side or in contact with the absorber on the other side. However, it is desirable that the release layer be between two dielectric spacers, rather than as was described above because there is greater assurance that the optical tamper evident device will separate into two parts between the dielectric spacers than there is when the release layer is between the dielectric spacer and the reflector or between the dielectric spacer and the absorber.

Still another embodiment of a tamper evident optical device is shown in FIG. 12 in which the optical tamper evident device 111 is provided with a polymer substrate 112 of the type hereinbefore described in connection with FIG. 11. The substrate 112 is provided with a surface 113 on which there is deposited a dielectric absorber layer 114. The dielectric absorber layer 114 is formed of a suitable material such as silicon or germanium and is deposited to a thickness ranging from 500 to 1600 Angstroms. The thickness of this layer is chosen to provide desired color. As, for example, at 500 Angstroms the color blue is provided, whereas at 800 Angstroms the color magenta is provided. The release layer 116 is then deposited on the dielectric absorber 114 and can be formed of a suitable material such as cryolite or Teflon to a thickness ranging from 20 to 100 Angstroms and preferably a thickness of approximately 60 Angstroms. A reflector layer 117 is deposited on the release layer 116 of a suitable material of the type hereinbefore described as, for example, aluminum to a thickness ranging from 400 to 1000 Angstroms and preferably a thickness of approximately 800 Angstroms. As pointed out above, it is necessary that the reflector layer 117 be opaque to visible light.

The optical tamper evident device 111 shown in FIG. 12 provides a selected color which will not shift with angle. When it is utilized in packaging, it will have the selected color and when tampering has occurred, the selected color will disappear and the reflected aluminum or silvery color will appear to clearly indicate that tampering has occurred. The optical tamper evident device 111 shown in FIG. 12 has an advantage over the tamper evident optical device shown in FIG. 11 in that it is comprised of fewer layers.

Figure 13:
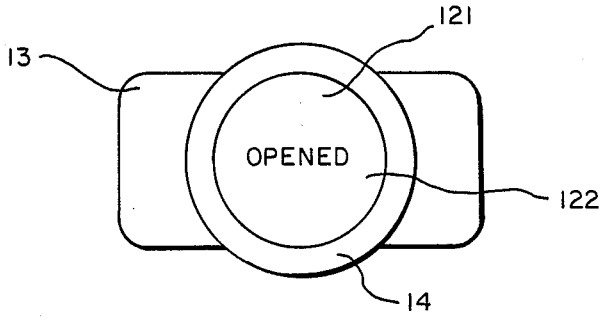
FIG. 13 is a plan view of a warning imprint that can be incorporated into the tamper evident optical device.

In connection with the optical tamper evident device of the present invention, it should be appreciated that the optical devices can be imprinted with an appropriate message as, for example "OPENED" as shown in FIG. 13. Thus an optical tamper evident device 121 can be provided in which an imprinting 122 has been printed onto the polymer substrate 101 in FIG. 11 or 112 in FIG. 12 by imprinting it on either of the two surfaces provided on the polymer substrate. This imprinting can be in a black or can be in a selected colored ink if desired. For example, if the color selected matches the color of the interference stack, the imprinted message will only be apparent after tampering has occurred. A clear ink may be employed in this fashion as well. Using a clear ink with low adhesion selectively prevents the destruction of the device which results in the pattern remaining where the ink is present. Thus, a message imprinted with a clear ink would only become visible after tampering occurs. Alternatively, a patterned adhesive could be used at surfaces 102 or 113 to selectively destroy the interference property of the film upon the occurrence of tampering thus exposing the message by the selective destruction of the device. In FIG. 13, the optical tamper evident device 121 has been incorporated into the cap 14 of the bottle 13 shown in FIGS. 7, 8 and 9.

From the foregoing it can be seen that there has been provided a tamper evident optical interference device which can be utilized in connection with various types of articles such as containers for packaging various products and particularly consumer type products. The optical tamper optical device can also be used on customs seals, classified document seals and the like. The tamper evident optical device can be readily incorporated into conventional type packaging utilized on consumer products. The tamper evident optical device has such characteristics that the public can be readily educated to ascertain whether or not tampering has occurred with respect to the container or package carrying the product. The consumer at the point of sale can readily ascertain whether tampering has occurred by viewing the optically variable device. If the optical tamper evident device is without color when viewed at different angles, the consumer will know that tampering has occurred and can bring this to the attention of the retailer distributing the product, or alternatively, the customer will see the printed word such as "OPENED" against a reflective background and would know that tampering has occurred.

What is claimed is:

1. In a tamper evident optical device having at least first and second layers with a spacer layer therebetween providing a desired optical property and a release layer disposed between the first and second layers to permit the first and second layers to be separated from each other and thereby separate the optical device into two parts and so that the desired optical property is destroyed, said release layer having been formed so that it does not affect to a significant degree the optical properties of the tamper evident optical device.

2. In a tamper evident optical device having at least first and second layers with a spacer layer therebetween providing a desired optical property and a release layer disposed between the first and second layers to permit the first and second layers to be separated from each other and thereby separate the optical device into two parts and so the desired optical property is destroyed, the release layer being relatively thin so that it does not affect to a significant degree the optical properties of the tamper evident optical device.

3. A device as in claim 2 wherein the release layer is formed of a material which has an index of refraction which is near that to the index of refraction of the material forming the spacer layer.

4. In a tamper evident optical device having at least first and second layers with a spacer layer therebetween providing a desired optical property and a release layer disposed between the first and second layers to permit the first and second layers to be separated from each other and thereby separate the optical device into two parts and so that the desired optical property is destroyed, the first layer being reflective layer and the second layer being an absorber layer, said reflective layer being formed of metal and said spacer layer being formed of a dielectric.

5. A device as in claim 4 wherein the release layer is disposed in the spacer layer.

6. A device as in claim 4 wherein the release layer is disposed between the spacer layer and the absorber layer.

7. A device as in claim 4 wherein the release layer is disposed between the spacer layer and the reflective layer.

8. A device as in claim 4 wherein the first and second layers and the spacer layer are carried by a substrate.

9. A device as in claim 8 wherein the substrate is formed of a transparent material.

10. A device as in claim 9 wherein said substrate is formed of a transparent plastic.

11. A device as in claim 8 wherein the spacer layer in combination with the release layer has an approximately one-quarter wavelength optical thickness at approximately 350 to 450 nanometers with the dielectric having an index of refraction of 1.0 and greater to provide an optical device in which the desired optical property is a black color having the appearance of a dark mirror.

12. A device as in claim 8 wherein the spacer layer in combination with the release layer has an approximately one-quarter wavelength optical thickness at 450 nanometers and above to provide an optical device in which the desired optical property is a selected color other than black.

13. A device as in claim 8 wherein the spacer layer in combination with the release layer has an approximately one-quarter wavelength optical thickness at 450 nanometers and above with a dielectric having an index of refraction of 1.9 and below to provide an optically variable device in which the desired optical property is a color shift with change in viewing angle.

14. A device as in claim 8 together with an imprint carried by the substrate.

15. A device as in claim 14 wherein said imprint is in the form of an ink in a selected color.

16. A device as in claim 14 wherein said imprint is formed by a clear ink having a low adhesion so that the imprint only becomes visible after tampering occurs.

17. A device as in claim 16 in which a patterned adhesive is provided on the substrate to provide the imprint.

18. In a tamper evident article, first and second parts which are movable with respect to each other, and a tamper evident optical device disposed between and being secured to the first and second parts, the tamper evident optical device having first and second layers and a release layer disposed between the first and second layers, said release layer forming a part of the tamper evident optical device but not affecting to a significant degree the optical properties of the tamper evident optical device, said release layer permitting separation of the tamper evident optical device into two separate parts whereby the desired optical characteristic is destroyed when the first and second parts are moved with respect to each other.

19. An article as in claim 18 wherein the article is a container having first and second flaps which are adapted to overlie each other and serve as said first and second parts.

20. An article as in claim 18 wherein said article is a bottle having a neck portion with an opening extending therethrough and having a cap removably secured to the neck portion and closing said opening and wherein the neck portion of the bottle and the removable cap serve as said first and second parts.

21. An article as in claim 20 wherein the tamper evident optical device is disposed between the top of the neck portion of the bottle and the interior of the cap.

22. An article as in claim 21 wherein the cap has at least a transport portion to permit viewing of the tamper evident optical device through the cap.

23. An article as in claim 18 wherein the article is a container having first and second flaps which are adapted to overlie each other and serve as said first and second parts, a portion of at least one of the first and second parts has a portion thereof which is formed in such a manner so as to permit viewing of the tamper evident optical device from the exterior of the container.

24. An article as in claim 23 wherein one of the first and second parts has an opening formed therein through which the tamper evident optical device can be viewed.

25. An article as in claim 24 wherein the tamper evident optical device includes a transparent substrate and wherein the tamper evident optical device is positioned between the first and second parts so that the substrate of the tamper evident optical device faces the opening.

26. An article as in claim 24 wherein the opening is formed by providing serrations in one of the first, second parts to deter cutting and removal of the optical tamper evident device through the opening.

27. In a tamper evident article, first and second parts which are movable with respect to each other, and a tamper evident optical device disposed between and secured to the first and second parts and being secured to the first and second parts, the tamper evident optical device having first and second layers and a release layer disposed between the first and second layers, said release layer forming a part of the optical device, said release layer permitting separation of the optical tamper evident device into two separate parts whereby the desired optical characteristic is destroyed when the first and second parts are moved with respect to each other, the tamper evident optical device being provided with at least three layers formed of a metal, a dielectric and a metal.

* * * * *